US005814184A

United States Patent [19]

Denkins

[11] Patent Number: 5,814,184

[45] Date of Patent: Sep. 29, 1998

[54] HAND OPERATED MUDLESS DRYWALL TAPE APPLICATOR

[76] Inventor: Jeffrey L. Denkins, W1952 County S, Kaukauna, Wis. 54130

[21] Appl. No.: 547,996

[22] Filed: Oct. 25, 1995

[51] Int. Cl.[6] ..... B65H 35/07

[52] U.S. Cl. ..... 156/577; 156/579

[58] Field of Search ..... 156/391, 475, 156/468, 495, 523, 527, 574, 576, 577, 545, 579

[56] References Cited

U.S. PATENT DOCUMENTS

| | | | |
|---|---|---|---|
| 1,967,748 | 7/1934 | Ehle | 156/461 |
| 2,533,209 | 12/1950 | Ames | 156/574 X |
| 3,140,217 | 7/1964 | Harbour | 156/577 |
| 3,332,827 | 7/1967 | Griffin et al. | 156/575 |
| 3,709,760 | 1/1973 | Knoner | 156/577 X |
| 3,745,086 | 7/1973 | Parker | 156/574 X |
| 3,785,901 | 1/1974 | Fritzinger | 156/574 X |
| 3,960,643 | 6/1976 | Dargitz et al. | 156/390 |
| 4,086,121 | 4/1978 | Ames | 156/526 |
| 4,197,624 | 4/1980 | Lass | 156/574 X |
| 4,406,730 | 9/1983 | Altmix | 156/574 |
| 4,652,331 | 3/1987 | Plasencia | 156/526 |
| 4,707,202 | 11/1987 | Sweeny | 156/71 |
| 4,826,557 | 5/1989 | Fu et al. | 156/579 |
| 5,073,228 | 12/1991 | Lin | 156/574 X |

*Primary Examiner*—Francis J. Lorin
*Attorney, Agent, or Firm*—Andrus, Sceales, Starke & Sawall

[57] ABSTRACT

A tape applicator effectively applies adhesive-backed drywall tape along both flat joints and corner joints. The applicator has a common tape dispenser to which a flat joint header and a corner joint header can be removably attached. The dispenser includes a tape guide located near a tape outlet for the dispenser as well as a tape break. The flat joint header has a cylindrical application roller with a resilient surface that allows the roller to follow the contour of the wall while maintaining proper pressure distribution to completely and securely press the tape against the wall. The corner header includes a creaser wheel that creases the tape into a corner and a guide roller that guides the tape from the dispenser outlet to the creaser wheel. A corner roller having a resilient surface can be used effectively to wipe down creased tape over a corner joint. Both the flat joint and corner headers include tape cutters to selectively cut tape dispensing from the apparatus. The applicator can be used with many kinds of adhesive-backed tapes, including reinforced drywall tape, fire tape and mesh tape.

20 Claims, 8 Drawing Sheets

FIG. 2
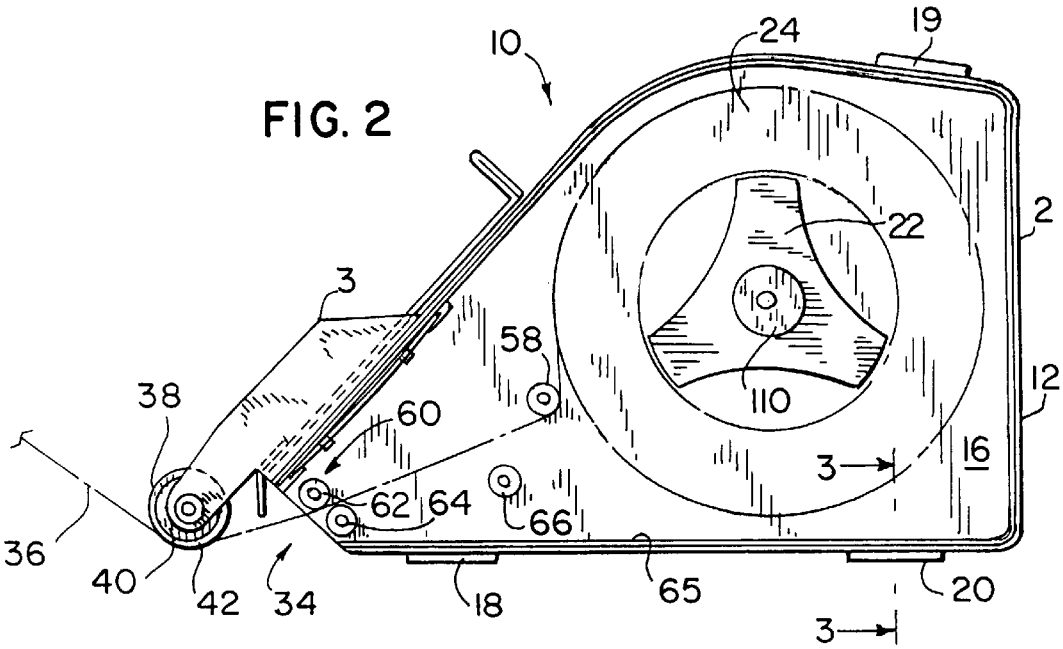
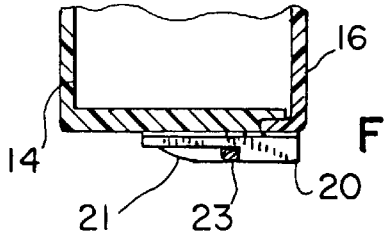
FIG. 3
FIG. 5
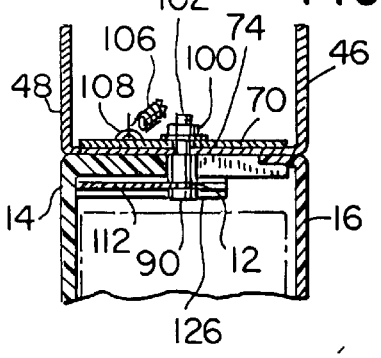
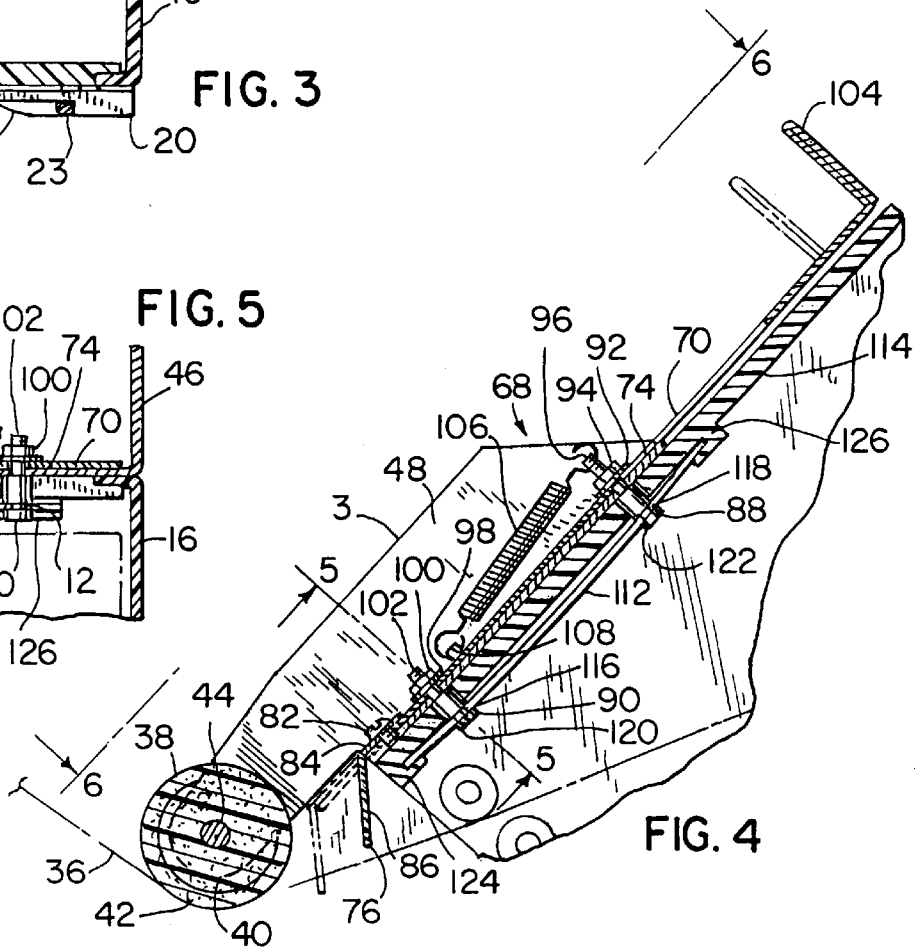
FIG. 4

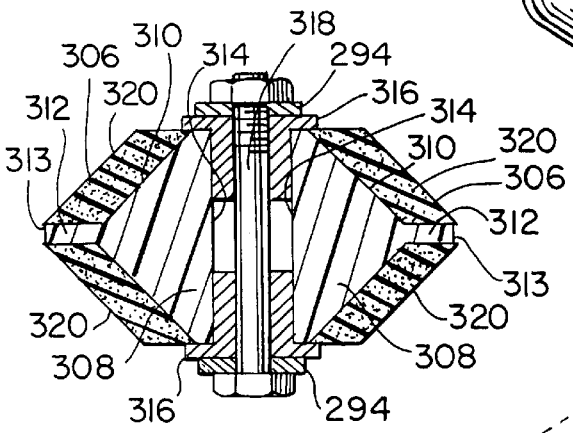
FIG. 12
FIG. 11
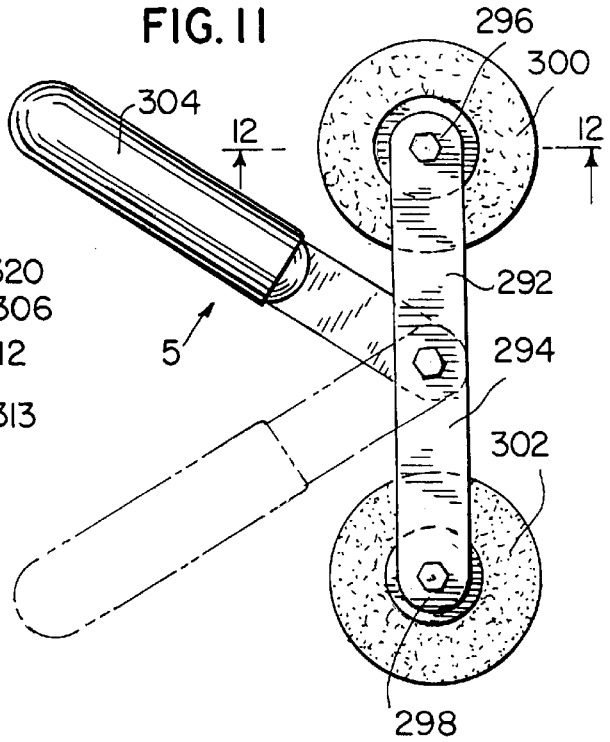
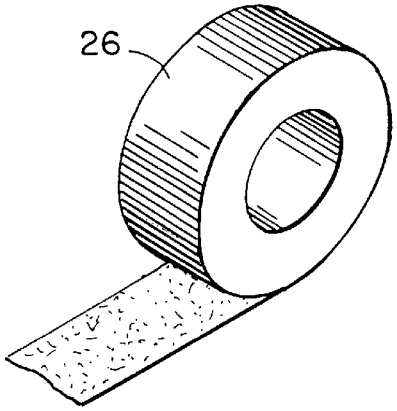
FIG. 13A
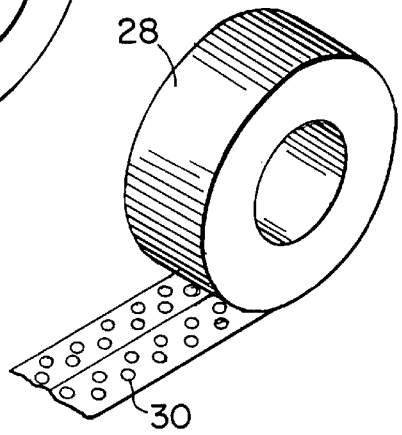
FIG. 13B
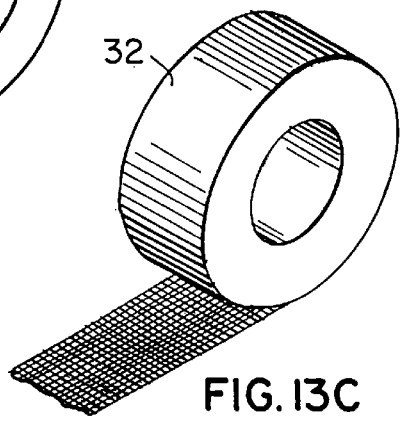
FIG. 13C

HAND OPERATED MUDLESS DRYWALL TAPE APPLICATOR

FIELD OF THE INVENTION

The invention relates to the taping of joints between sheets of drywall. In particular, the invention relates to a hand operated apparatus for applying adhesive-backed drywall tape, including reinforced adhesive-backed drywall tape and mesh drywall tape having a tacky back.

BACKGROUND

Conventional drywall tape is usually made of paper, and does not have an adhesive backing. It is secured over joints between sheets of drywall with joint compound, sometimes called mud. Prior art devices such as those disclosed in U.S. Pat. Nos. 4,652,331; 4,086,121; and 3,960,643 have been developed to contemporaneously apply tape and mud to seal drywall joints. In these devices, tape typically is coated with mud as the tape is drawn through rollers from a continuous roll of tape. The mud coated tape is then applied over drywall joints, and pressed into place with the rollers. Even with these prior art devices, the process of applying conventional drywall tape with mud is labor intensive and time consuming.

Reinforced adhesive-backed drywall tape, otherwise known as mudless tape, can reduce the amount of labor and time involved for drywalling. Reinforced adhesive-backed drywall tape adheres directly to the drywall over joints between two sheets of drywall. When applying the mudless tape, it is important that the tape adhere securely to the drywall surface, and also that there are no bubbles or creases in the tape. After the tape is applied to the drywall surface, mud is smoothed over the tape and finished.

Prior art devices such as those disclosed in U.S. Pat. Nos. 4,406,730 and 4,707,202 have been developed to apply mudless tape over drywall joints. While the use of reinforced adhesive-backed drywall tape should be much more time efficient than conventional non-adhesive tape using mud for adhesion, the devices in U.S. Pat. Nos. 4,707,202 and 4,406,703 have not gained widespread use throughout the drywall industry.

When applying reinforced adhesive-backed drywall tape, it is necessary to draw the tape from the roll and apply the tape over a joint which may be short (e.g. 2–3 inches) or long (e.g. 8, 10, 12 or possibly up to 50 feet long). Over long distances, it can be awkward to properly apply the tape over the joint without creating unsightly bubbles, creases or wrinkles in the tape. It is desirable that such an apparatus be easy for workmen to manipulate both along straight joints and along corner joints. Furthermore, it is important that a drywaller can easily and precisely cut the tape at the end of a run, and can also easily and precisely start the tape at the beginning of a run. One of the most important requirements of such a device is that the device apply the tape in a straight, controllable manner over the joint.

SUMMARY OF THE INVENTION

The invention provides an apparatus that efficiently applies adhesive-backed drywall tape both along flat joints and corner joints. The invention can also be used to apply sticky mesh drywall tape.

In one aspect, the invention is a tape applicator especially designed to apply adhesive-backed joint tape over flat joints between sections of wallboard. In another aspect, the invention is a tape applicator especially designed to apply adhesive-backed joint tape over corner joints. In yet another aspect, the invention is a kit using a common tape dispenser to which either a flat joint header or a corner joint header can be removably attached.

In accordance with the invention, the flat joint tape applicator includes a housing or dispenser to which a tape holder is mounted. The tape holder is intended to hold a roll of adhesive-backed joint tape. Tape from the tape holder dispenses the housing through a tape outlet. A tape guide, preferably a roller nip, is positioned in the housing by the tape outlet. A cylindrical application roller having a resilient surface is mounted to the housing and positioned to the exterior of the housing near the tape outlet. The cylindrical application roller has a flat cylindrical surface that contacts the back side or non-adhesive side of the tape as the tape dispenses through the tape outlet. The cylindrical application roller is preferably constructed of a hard cylindrical core surrounded by a ¼ inch layer of foam rubber material. The layer of foam rubber allows the roller to follow the contour of the wall over the joint, while at the same time maintaining an appropriate distribution of pressure over the tape to enhance the likelihood that the tape will stick completely and securely to the wall.

The tape guide is preferably a roller nip comprised of an upper roller and a lower roller in close proximity to one another. The tape passes between the upper and lower roller so that the upper non-adhesive surface of the tape is exposed to the upper roller and the lower adhesive surface of the tape is exposed to the lower roller. The lower roller preferably has a non-stick surface.

Additionally, a positioning roller is preferably mounted to the housing in a fixed location relative to the tape guide in the vicinity of the tape holder. The positioning roller is located so that the back non-adhesive surface of the tape contacts the positioning roller when the tape dispenses from the roll of tape on the tape holder through the tape outlet. The purpose of the positioning roller is to maintain the tape in a consistent direction as the tape approaches the tape guide (e.g. the tape guide roller nip) from the roll of tape even though the size of the roll of tape varies when the applicator is used.

The corner joint tape applicator is similar in many respects to the flat joint tape applicator, except the cylindrical application roller having a resilient surface is replaced by a hard guide roller and a creaser wheel. The hard guide roller on the corner joint applicator is attached to the housing and positioned to the exterior of the housing near the tape outlet. The creaser wheel is mounted in a spaced apart relationship forward of the hard guide roller. The hard guide roller has an indentation for receiving and guiding the tape as the tape dispenses from the tape outlet towards the creaser wheel. The preferred creaser wheel is about ¼ inch thick and has a flat ⅛ inch edge for contacting the back non-adhesive side of the tape to crease the tape into a corner on the wall.

Both the flat joint applicator and the corner joint applicator have a tape cutter that can selectively cut the tape dispensing from the apparatus. In the flat joint tape applicator, the tape is cut at a location between the tape outlet and the cylindrical application roller. In the corner joint applicator, the tape is cut at a location between the guide roller and the creaser wheel.

Since the design of the dispenser for the flat joint applicator and the corner joint applicator are preferably similar and can be made identical, the invention contemplates a kit in which the tape applicator can be readily converted between a corner joint applicator and a flat joint applicator. The kit includes a common tape dispenser including a tape holder and a tape guide positioned by a tape outlet in the dispenser housing. The kit also includes a flat joint header and a corner joint header that can each be removably attached to the dispenser. The flat joint header includes a cylindrical application roller having a resilient surface as described above and a tape cutter that cuts tape dispensing from the tape outlet at a location between the tape outlet and the application roller. The corner joint header includes a hard guide roller and a creaser wheel as described above, and a tape cutter that cuts tape dispensing from the tape outlet at a location between the guide roller and the creaser wheel.

The kit can also include a corner roller for wiping down tape that is creased into a corner with the corner joint unit. The preferred corner roller includes two pairs of flat cylindrical rollers connected to a frame. Each pair includes a first roller having an axis of rotation and a second roller mounted in close proximity to the first roller in such an orientation that the axis of rotation for the second roller is substantially perpendicular to the axis of rotation for the first roller. The first roller presses the creased joint tape onto one of the intersecting walls at a corner joint, while the second roller presses the creased joint tape onto the other intersecting wall at the corner joint. Each of the rollers has a resilient roller surface. Preferably, the rollers have a hard internal core and a layer of foam rubber covering the surface of the hard inner core. Again, the layer of foam rubber allows the rollers to follow the contour of the walls while maintaining proper pressure distribution to enhance the likelihood that the tape will stick completely and securely over the joint.

Other advantages and features of the invention will be apparent upon reviewing the drawings and the following description thereof.

BRIEF DESCRIPTION OF THE DRAWINGS

FIG. 2 is a side elevational view of an apparatus in accordance with the invention for applying adhesive-backed joint tape over flat joints between sections of wallboard.

FIG. 3 is a sectional view taken along lines 3—3 in FIG. 2.

FIG. 4 is a detailed view showing a removable flat joint header attached to the apparatus shown in FIG. 2.

FIG. 5 is a sectional view taken along lines 5—5 in FIG. 4.

FIG. 11 is a side elevational view of a corner roller in accordance with the invention.

FIG. 12 is a sectional view taken along lines 12—12 in FIG. 11.

FIGS. 11*a*, 13*b* and 13*c* show different types of adhesive-backed joint tape that can be used in the apparatus of the present invention.

DETAILED DESCRIPTION OF THE DRAWINGS

Figure 1:
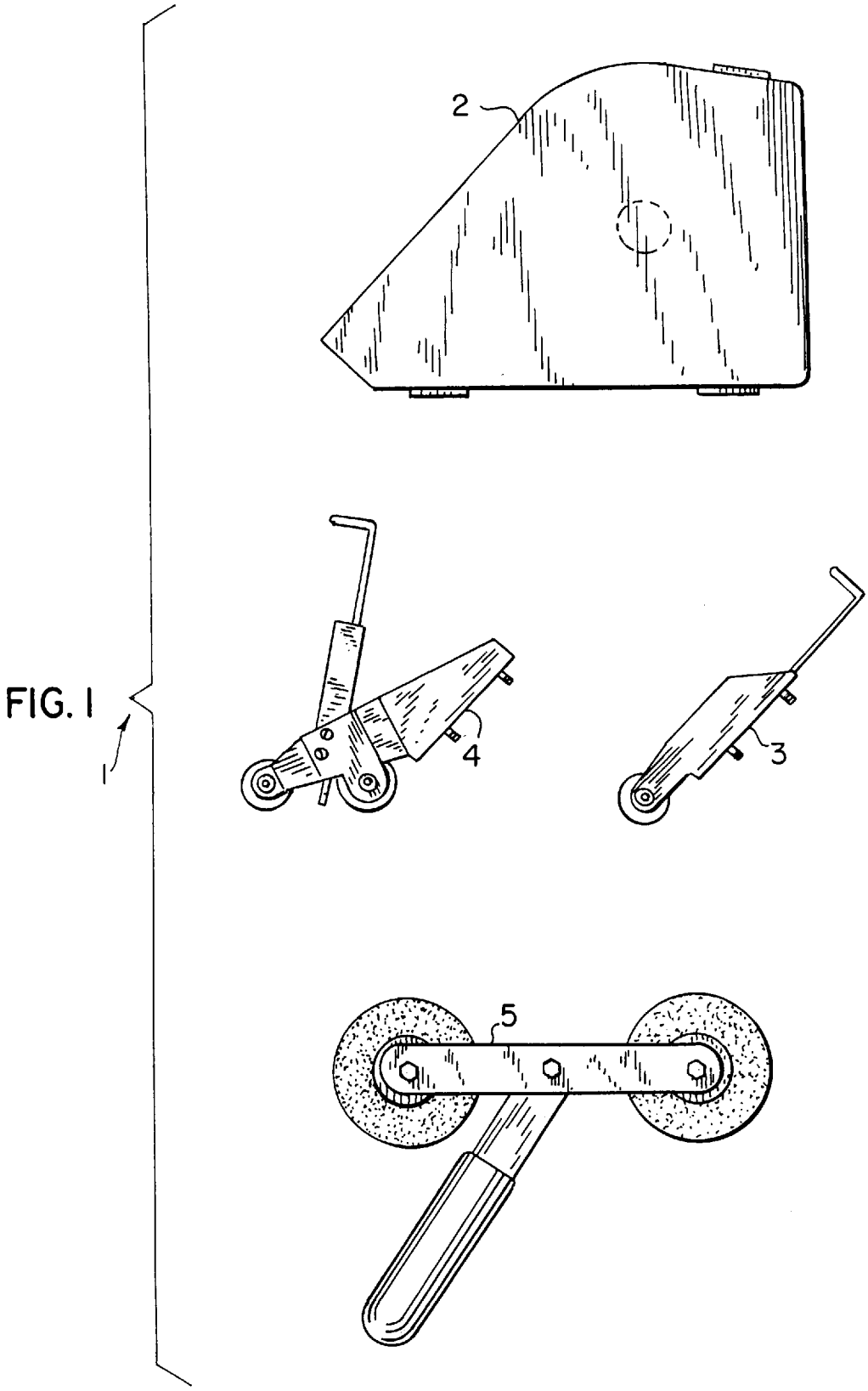
FIG. 1 illustrates a kit in accordance with the invention for applying adhesive-backed joint tape over flat joints and corner joints between sections of wallboard.

FIG. 1 shows the components of a kit 1 for applying adhesive-backed joint tape over flat joints between sheets of wallboard and corner joints between sheets of wallboard. The components of the kit include a common tape dispenser 2, a flat joint header 3 that can be removably attached to the common dispenser 2, a corner joint header 4 that can be removably attached to the common dispenser 2, and a corner roller 5. The kit 1 accommodates the application of adhesive-backed drywall tape over flat joints by attaching the flat joint header 3 to the common dispenser 2, or over corner joints by attaching the corner joint header 4 to the common tape dispenser 2. The corner roller 5 is used to wipe down joint tape after the tape has been creased into a corner joint. The kit 1 can include a different type of corner roller such as the corner roller 6 shown in FIGS. 19–21. Alternatively, the kit 1 might eliminate a corner roller all together.

FIGS. 13*a*, 13*b* and 13*c* show examples of the types of adhesive-backed joint tape that the invention is particularly well-suited to apply. The term "adhesive-backed joint tape" as used herein includes but is not limited to the types of tape shown in FIGS. 13*a*, 13*b* and 13*c*. FIG. 13*a* illustrates a roll of adhesive-backed fire tape 26. The fire tape 26 is preferably reinforced tape having a width of about 1 ⅞ inches. Fire tape is typically applied over joints between wallboard in applications such as crawl spaces where it is not necessary to finish the joint with mud.

FIG. 13*b* illustrates a roll 28 of reinforced adhesive-backed drywall tape. The roll of drywall tape 28 is preferably similar to the roll of fire tape 26, except the roll of drywall tape has a pattern of holes 30 therethrough. Note that it is preferred that the holes 30 be located away from the center line of the tape. This improves the strength of the tape for creasing the tape into corners. One function of the holes 30 is to reduce bubbles or blisters under the tape 28 when the tape is applied to the wall. Another function of the holes is to allow the mud to come in direct contact with the drywall through the holes 30. Thus, in the future, adherence of the tape 28 to the drywall does not rely solely on the integrity of the adhesive on the back side of the tape 28.

FIG. 13*c* illustrates a roll 32 of drywall mesh tape having a tacky or adhesive back side. In general, the mesh tape 32 can be used in the same manner as the drywall tape 28 for sealing over drywall joints. The invention is particularly well suited for applying the types of tapes shown in FIGS. 13*a*, 13*b* and 13*c* (i.e., the reinforced adhesive-backed drywall tape 28 having holes (FIG. 13*b*), the mesh drywall tape 32 having a tacky back (FIG. 13*c*), and the fire tape 26 without holes (FIG. 13*a*)).

FIGS. 2 through 6 illustrate a hand operated mudless drywall tape applicator 10 in which the flat joint header 3 is removably attached to the common dispenser 2. The common dispenser 2 has a substantially fully enclosed housing 12 formed by a first housing member 14 and a second housing member 16, FIG. 3, which are snapped together via snaps 18, 19 and 20. FIG. 3 shows a snap engagement means for snapping together housing members 14 and 16. In FIG. 3, a push button type snap has a spring actuated push button mechanism 21 mounted to housing member 14 and a snap retention bar 23 is mounted to housing member 16.

A tape holder 22 is mounted to the housing 12, and in particular to housing member 16. The tape holder 22 holds a roll of joint tape 24, preferably one of the types shown in FIGS. 13*a*–13*c*. The housing 12 includes a tape outlet 34, and tape 36 dispenses from the roll 24 located in the housing through the tape outlet 34. It may be desirable to provide a window or an opening in the housing 12 to allow inspection of the roll 24 of tape.

A cylindrical application roller 38 is attached to the housing 12 and positioned to the exterior of the housing 12 near the tape outlet 34. As the tape 36 dispenses from the tape outlet 34, the cylindrical application roller 38 pushes the tape 36 over flat joint between the sections of wallboard.

Figure 6:
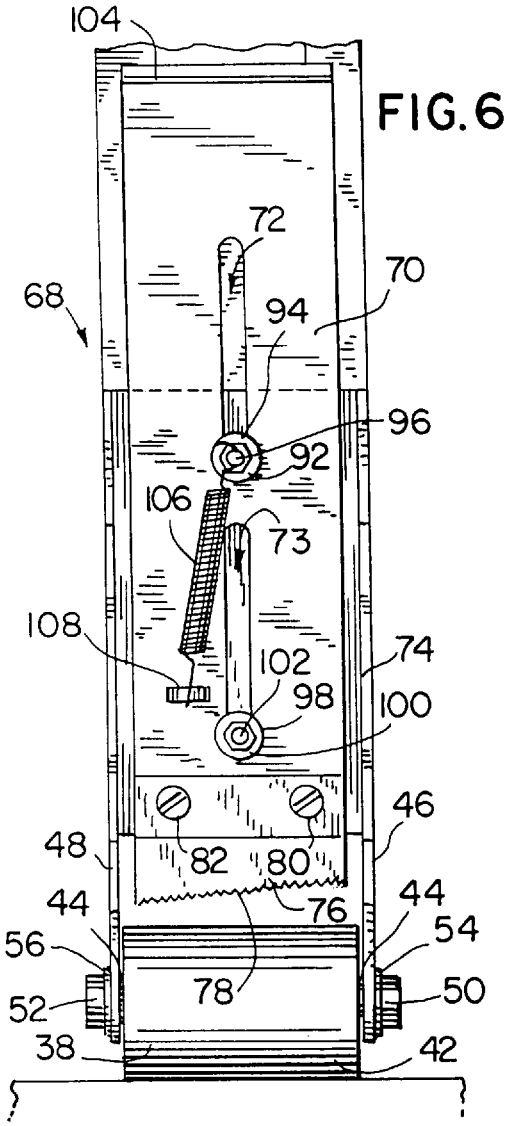
FIG. 6 is a view taken along lines 6—6 in FIG. 4.

The cylindrical application roller 38 has a hard, cylindrical core 40 surrounded by a flat resilient surface 42. The hard, cylindrical core is preferably made of a high density polyethylene. The resilient surface 42 surrounding the hard core is preferably a ¼ inch layer of foam rubber. The hard core 40 of the cylindrical application roller 38 is mounted to an axle 44. One end of the axle 44 is rotatably supported by a first roller support member 46, and the other end of the axle 44 is rotatably supported by a second roller support member 48. Bearings or bushings can be provided in the roller support members 46 and 48 to rotatably support the axle 44 so that the application roller 38 can be free to roll. In FIG. 6, bushings 50 and 52 are secured to the support members 46 and 48 using snap rings 54 and 56, and the axle 44 is supported for rotation in the bushings 50 and 52.

The preferred width of the resilient surface 42 across the application roller 38 is between 2 and ¾ inches, and the preferred outer diameter of the application roller 38 is approximately 1 ½ inches. The resilient surface 42 allows the cylindrical application roller 38 to follow the contour of the wall over the joint, while maintaining an appropriate distribution of pressure on tape to enhance the likelihood that the tape will stick completely to the wall.

Referring in particular to FIG. 2, tape 36 dispensing from the roll of tape 24 on the tape holder 22 is positioned by a positioning roller 58 mounted to the housing 12. The positioning roller 58 is located in a fixed position relative to the tape outlet 34. The top side (i.e. the non-adhesive surface) of the tape 36 contacts the positioning roller 58 when the tape passes the positioning roller 58 as the tape dispenses. In this manner, the positioning roller 58 aligns the tape dispensing through the tape outlet 34 in a consistent direction which does not vary as the roll of tape 24 becomes smaller during use.

A tape guide 60 is located in the housing 12 near the tape outlet 34. The tape guide 60 guides the tape 36 from the positioning roller 58 through the tape outlet 34 to the cylindrical application roller 38. The preferred tape guide 60 is a roller nip having an upper roller 62 and a lower roller 64, each rotatably mounted to the housing member 16. It may be useful to mount one end of the rollers 62 and 64 directly to the housing member 16 and the other end to a mounting bracket (not shown). The lower roller has an outer surface made of a non-stick material, such as TEFLON. The upper roller 62 and the lower roller 64 are located in close proximity to each other, so that the non-adhesive surface of the tape 36 is exposed to the upper roller and the adhesive surface of the tape 36 is exposed to the lower roller 64 as the tape passes through the roller nip 60.

A stick prevention roller 66 can also be mounted to the housing member 16 above the floor 65 of the housing. Again, it may be useful to use a mounting bracket (not shown). The stick prevention roller 66 is located underneath the normal path of the tape 36 between the positioning roller 58 and the roller nip 60. The stick prevention roller 66 preferably has a non-stick surface. The purpose of the stick prevention roller is to prevent the tape from sticking to the floor 65 of the housing 12 in case the tape 36 sags between the positioning roller 58 and the roller nip 60.

Figure 7:
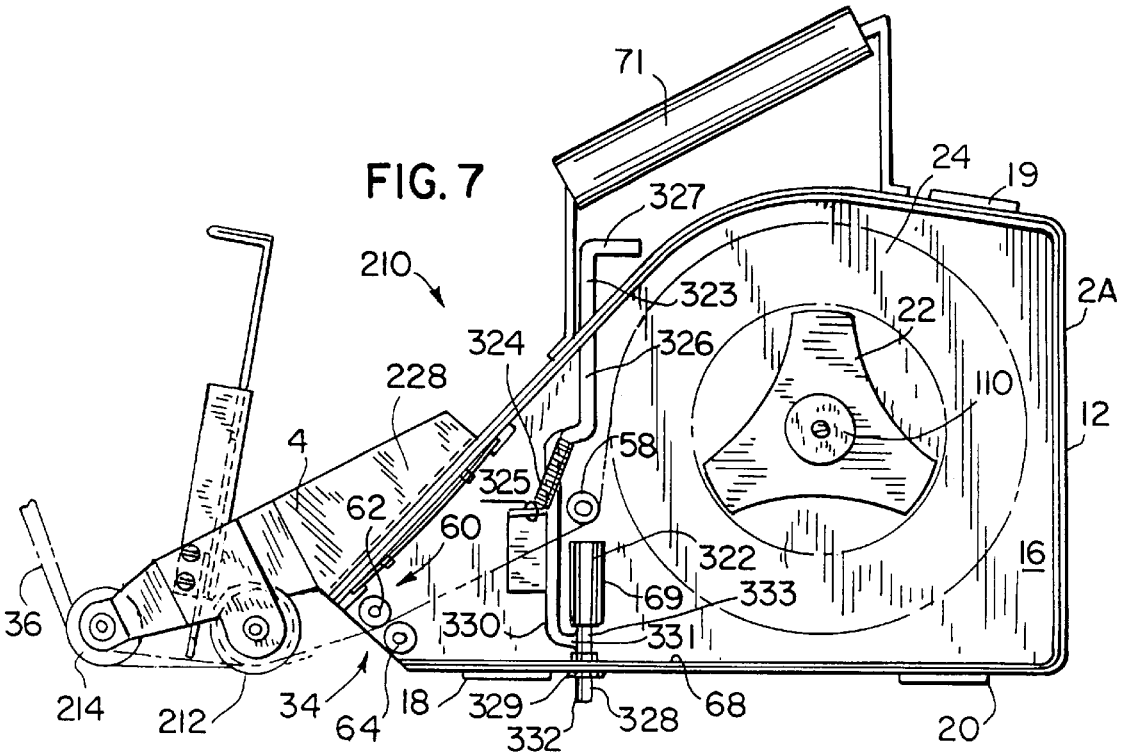
FIG. 7 is a side elevational view of an apparatus in accordance with the invention for applying adhesive-backed joint tape over corner joints.

The dispenser 2 shown in FIG. 2 is similar in many respects to the dispenser 2A shown in FIG. 7. The dispenser 2A in FIG. 7 has a tape break 69 that cooperates with the positioning roller 58 to squeeze the tape 36 and prevent the tape 36 from dispensing when the break 36 is actuated. Because of the presence of the break 69, the dispenser 2A in FIG. 7 doe not have a stick prevention roller 66 mounted above the floor 65 of the housing 12. The dispenser 2A also includes a top handle 71 mounted to the top of the housing 12, which is not present in the dispenser 2 shown in FIG. 2.

Referring now in particular to FIGS. 4 and 6, the tape applicator 10 includes a tape cutter 68 that can be used by an operator to selectively cut tape dispensing from the applicator 10 at a location between the tape outlet 34 and the application roller 38. The tape cutter 68 includes a slide member 70 preferably having two elongated guide slots 72 and 73. A header base member 74 spans between the roller support members 46 and 48. The header base member 74 and the roller support members 46 and 48 can be made of a single piece of bent sheet metal, or can be made separate pieces or combinations thereof as shown in FIG. 5.

A cutting blade 76 is integral with a forward end of the slide member 70. The cutting edge 78 of the blade 76 is preferably serrated. As shown in FIGS. 4 and 6, the cutting blade 76 is connected to the forward end of the slide member 70 using screws 80 and 82. As shown best in FIG. 4, the cutting blade 76 has a connecting portion 84 that is substantially parallel to the sliding member 70 and a penetration portion 86 that slants downward from the connecting portion 84.

A first header connection member 88 and a second header connection member 90 are attached to the header base member 74. The header connection members 88 and 90 each have a guide post extending axially through the header base member 74. The header connection member 88 is attached to the header base member 74 using a washer 92 and nut 94 secured to guide post 96. The header connection member 90 is attached to the header base member 74 using a washer 98 and nut 100 secured to guide post 102. The guide posts 96 and 100 are received in the elongated guide slots 73 and 72 on the slide member 70. In the preferred embodiment, the guide member 70 is slidably mounted to the header base member 74 by sandwiching the slide member 70 between the header base member 74 and the washers 92 and 98 in the area surrounding the guide slots 72 and 73 on the slide member 70. Since the header is attached to the housing 12, the guide posts 102 and 96 are generally stationary with respect to the housing 12.

The slide member 70 includes an operator handle 104 at a rearward end of the slide member 70. A return spring 106 is attached between the slide member 70 at location 108 and guide post 96. The tape cutter 68 can be actuated by an operator to cut tape 36 between the tape outlet 34 and the application roller 38 by pushing the operator handle 104 on the slide member 70 against the force of the return spring 106 so that the slide member 170 moves forward with respect to the guide posts 96 and 102, thus pushing the penetration portion 86 of the cutting blade 78 against the tape 36.

Figure 14:
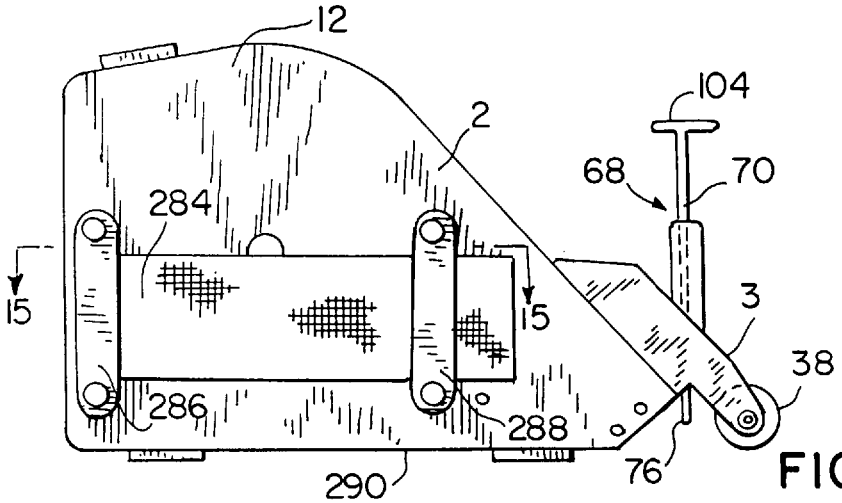
FIG. 14 is a side elevational view showing an apparatus in accordance with the invention having a hand strap.

FIG. 14 shows a slightly different configuration for the tape cutter 68 in which the tape cutter 68 has a straight (i.e. not bent) cutting blade 76. In FIG. 14, the slide member 70 and the integral straight cutting blade 76 are mounted in-line with the cutting direction of the cutter 68 (i.e. at a sharp downward angle).

In order for the tape cutter 68 to properly cut the tape, there must be sufficient tension on the tape 36. The proper amount of tension can be applied by tape holder 22. It may be desirable to have a tape holder 22 having an adjustable tensioner 110, FIG. 2. Alternatively, an operator actuated tape break (shown in FIG. 7 by reference numeral 69) can be used to secure the tape by squeezing the tape against the positioning roller 58.

A clip 112 mounted to the inside surface 114 of the housing 12 receives the header connection members 88 and 90 for the removable attachment of the header 3 to the housing 12. The clip 112 is a generally flat rectangular shape of metal having a length of about 3 to 3 ½ inches. The clip 112 is attached to the housing 12 by a front boss 124 and a rear boss 126. The clip 112 preferably has a slight arc towards the interior of the dispenser when clip 112 is attached between the bosses 124 and 126. The clip 112 has two connector slits 116 and 118. The slits 116 and 118 have a width that is less than the general width of the connection members 88 and 90, however, each of the connection members 88 and 90 has a circumferential groove 120 and 122. The diameter of the connection members 88 and 90 is sufficiently reduced at the grooves so that the grooved portions 120 and 122 of the connection members 88 and 90 can be received within the slots 116 and 118 of the clip 112. The header 3 can be removed from the common dispenser 2 by moving the header 3 laterally across the surface of the dispenser 2 to disengage the connection members 88 and 90 from the clip slots 116 and 118.

Figure 16:
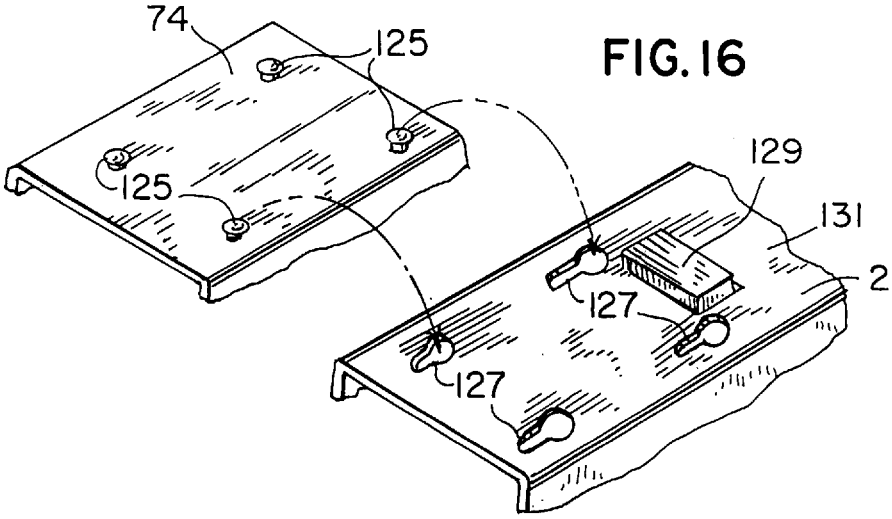
FIG. 16 is a perspective view of an alternative mechanism for removably attaching either a flat joint header or a corner joint header to the apparatus shown in FIGS. 2 or 7.
Figure 17:
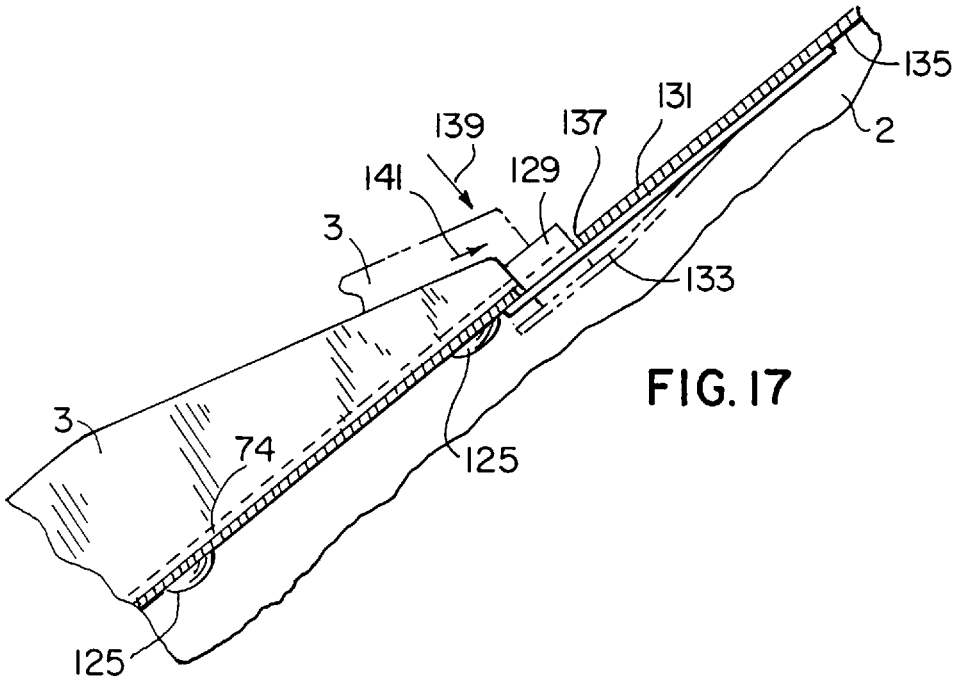
FIG. 17 is a side elevational view of the mechanism shown in FIG. 16.
Figure 18:
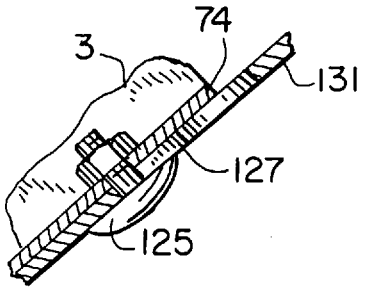
FIG. 18 is a detailed view showing part of the mechanism shown in FIG. 17.

FIGS. 16–18 show an alternative way of removably attaching the header base member 74 to the top of the dispenser 2 or 2A. As shown in FIG. 6, this alternative attachment means includes four mushroom-shaped studs 125 on the header base member which can be removably secured in corresponding keyhole-shaped slots 127 in the top of the dispenser. A spring loaded securing boss 129 extends through the top 131 of the dispenser 2 and serves to secure the header base member 74 tightly in position when the mushroom-shaped studs 125 are inserted in the keyholed slots 127. As shown best in FIG. 17, the spring loaded boss 129 is preferably integral with or attached to a leaf spring 133 which is attached to the inside surface 135 of the top 131 of the dispenser 2. The tension of the spring 133 pushes the boss 129 through a hole 137 in the top 131 of the dispenser 2. To attach the header 3 to the dispenser 2, the mushroom-shaped studs 125 are lined up with the large portions of the keyholed slots 127. The header 3 is then pushed towards the dispenser 2 so that the header base member 74 pushes downward on the spring loaded boss 129 thus moving the boss 129 and allowing the studs 125 to pass through the keyholed slots 127, as depicted by arrow 139. The header 3 is then slid forward as depicted by arrow 141 to secure the studs 125 in the narrow portion of the keyholed slots 127. When the header 3 is slid forward, the spring 31 pushes the boss 129 upward, thus obstructing rearward movement of the header 3 to securely hold the header 3 in place on top of the dispenser 2. To remove the header 3, a user merely pushes down on the boss 129 against the force of the spring 133, and pulls the header 3 back so that the studs 125 line up with the large portions of the keyholed slots 127 in the top 131 of the dispenser 2. This alternative attachment means shown in FIGS. 16–18 can be easily implemented with the header 3 shown in FIG. 14 having the straight cutter blade 76 and the tape cutter 68 oriented at a sharp downward angle.

Figure 15:
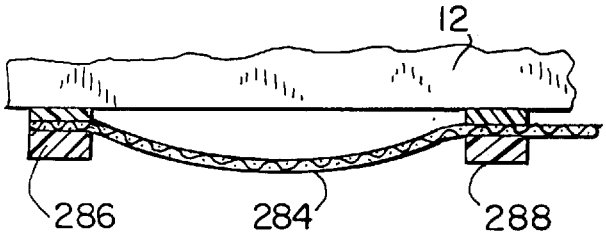
FIG. 15 is a view taken along line 15—15 in FIG. 4.

In FIGS. 14 and 15, the common dispenser 2 preferably includes a handle strap 284 attached to the housing 12 with attachment members 286 and 288. To use the applicator, an operator can place their hand underneath the strap 284 and wrap their fingers around the bottom 290 of the applicator. This type of handle configuration provides the operator with good control of the applicator.

FIGS. 7 through 10 illustrate a hand operated mudless drywall tape applicator 210 in which a corner joint header 4 is removably attached to the common dispenser 2A. The apparatus 210 preferably uses a common dispenser (e.g. dispenser 2 shown in FIG. 2, or dispenser 2A shown in FIG. 7) as the apparatus 10 for applying adhesive-backed joint tape over flat joints between sections of wallboard; however, in apparatus 210 the corner joint header 4 is removably attached to the common dispenser 2 instead of the flat joint header 3.

The corner joint header 4 has a hard guide roller 212 positioned to the exterior of the housing 12 near the tape outlet 34. The corner joint header 4 also has a creaser wheel 214 that is positioned exterior of the housing 12 in a spaced apart relationship from the hard guide roller 212. The hard guide roller 212 guides tape 36 dispensing from the tape outlet 34 towards the creaser wheel 214. The creaser wheel 214 has an edge contacting the non-adhesive surface of the tape, which pushes or creases the tape 36 into a corner joint. Note that the creaser wheel 214 should be located far enough away from the tape outlet 34 so that an operator can have a sufficient amount of room to maneuver the applicator 210 within corners often characterized by restricted work space. The corner joint header 4 has a tape cutter 216 that cuts the tape 36 at a location between the hard guide roller 212 and the creaser wheel 214.

Figure 8:
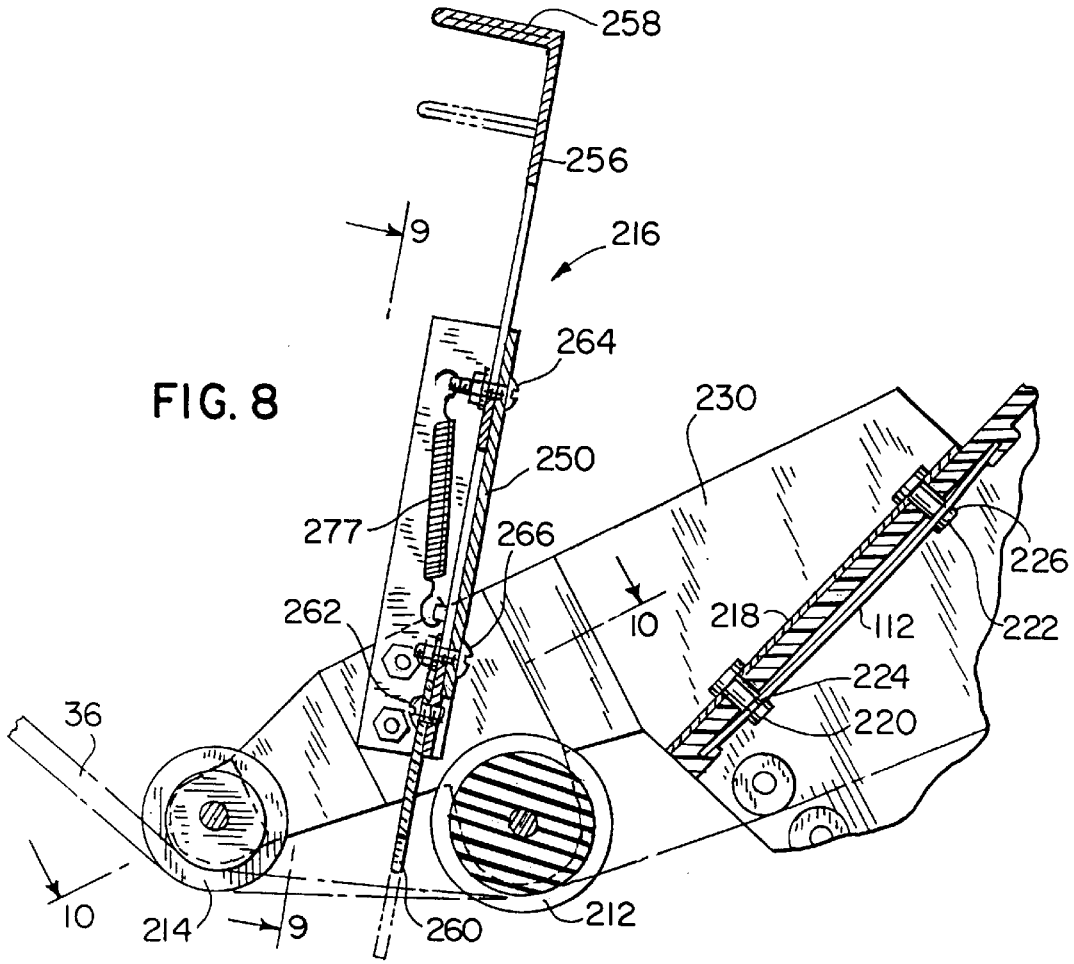
FIG. 8 is a detailed view of a removable corner joint header attached to the apparatus shown in FIG. 7.

More specifically, the corner joint header 4 includes a header base member 218 through which header connection members 220 and 222 are attached (see FIG. 8). The header connection members 220 and 222 each include a grooved portion 224 and 226, respectively, which are received in corresponding slots in the clip 112, as described above in relation to FIGS. 4 and 5. Note, however, that the header connection members 220 and 222 do not include axial guide posts for directing the path of movement of the cutter mechanism 216. Alternatively, a connection mechanism similar to that shown in FIGS. 16–18 may be used to removably attach the header base member 218 to the top of the dispenser 2A.

Figure 10:
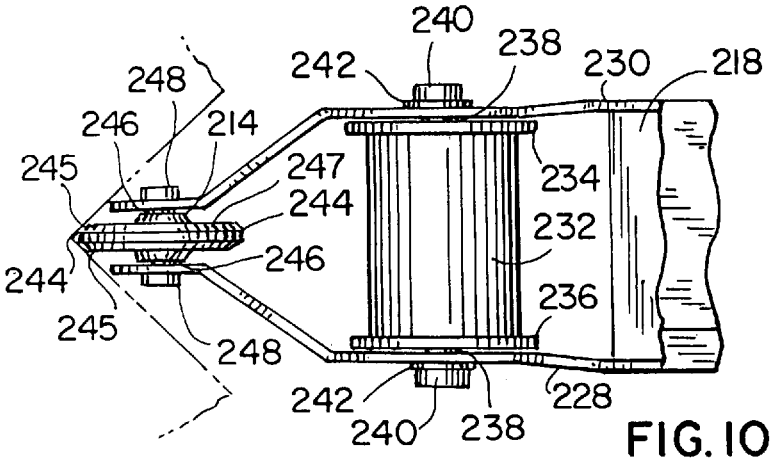
FIG. 10 is a view taken along lines 10—10 in FIG. 8.

Integral with the header base member 218 are a first roller support member 228 and a second roller support member 230, FIG. 10. The hard guide roller 212 and the creaser wheel 214 are rotatably supported between the first and second roller support members 228 and 230.

The hard guide roller 212 is rotatably mounted between the roller support members 228 and 230, preferably using axle 238, and bushings 240 which are attached to the roller support members 228 and 230 with snap rings 242. The hard guide roller 212 is preferably made of high density polyethylene. The hard guide roller 212 has a circumferential indentation 232 between two circumferential sidewalls 234 and 236. The indentation 232 between sidewalls 234 and 236 is sized to receive the tape 36. The width of the indentation 232 is preferably about 2 inches wide, and the depth of the indentation 232 is preferably about ⅛ inch deep. The non-adhesive side of the tape contacts the hard guide roller 212 as the tape dispenses through the tape outlet 34 towards the creaser wheel 214.

The creaser wheel 214 is mounted between the forward ends of the first and second roll support members 228 and 230 in a spaced apart relationship from the hard guide roller 212. The creaser wheel 214 can be mounted for rotation to the first and second roller support members 228 and 230 with an axle 246/bushing 248 arrangement, or otherwise. Note that the roller support members 228 and 230 bend towards one another as the members 228 and 230 extend forward from the hard guide roller 212 to the creaser wheel 214. The creaser wheel 214 is preferably a hard polyethylene wheel having a main portion 247 with a thickness of about ¼ inch. The creaser wheel 214 preferably has a flat ⅛ inch outer edge 244, which is separated from the wheel 214 sides by beveled portions 245. The diameter of the creaser wheel is preferably between 1 ½ to 2 ¾ inches. The hard creaser wheel 214 creases the tape 36 into a corner joint, but an operator must follow-up afterwards with either a corner roller such as corner roller 5 (FIGS. 11 and 12), or corner roller 6 (FIGS. 19–21), with a drywall knife, or with hands to apply pressure to the tape so that the tape adheres to the wall over the corner joint.

The tape cutter 216 on the corner joint header 4 includes a cutter base 250 that is rigidly connected between the roller support members 228 and 230 using nuts 252 and bolts 254. The cutter base member 250 is attached to the roller support members 228 and 230 so that the tape cutter 216 is oriented at a sharp downward angle. This orientation facilitates use of the cutter 216 in corners where work space is usually restricted. In addition, this orientation allows room for a top handle 71 as shown in FIG. 7. Therefore, if the common dispenser includes a top handle 7, it is desirable that both the tape cutter 216 for the corner unit and the tape cutter 68 for the flat joint unit be oriented at a sharp downward angle.

Figure 9:
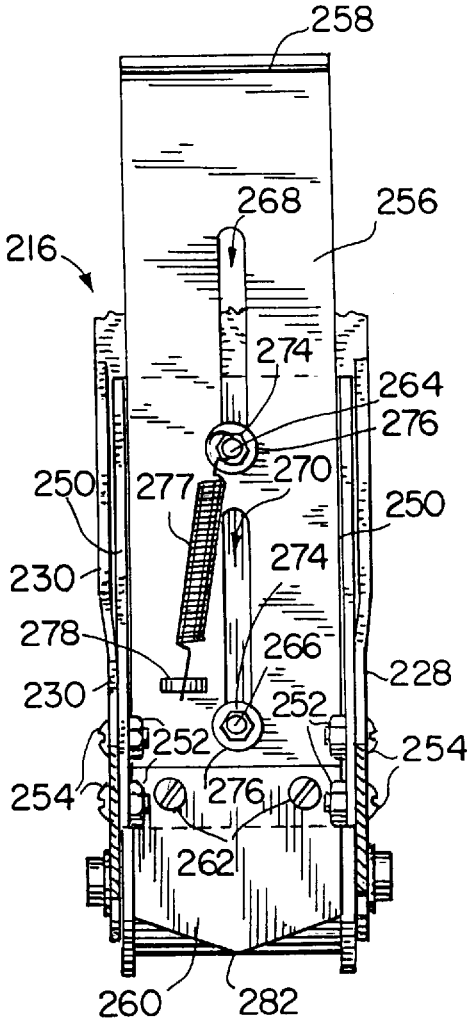
FIG. 9 is a view taken along lines 9—9 in FIG. 8.

A cutter slide member 256 is slidably mounted to the cutter base member 250. The cutter slide member 256 has an integral handle 258 at the top or rearward end and a cutting blade 260 integral with or attached to the bottom or forward end of the slide member 256. As shown in FIGS. 8 and 9, the cutting blade 260 is attached to the front end of the slide member 256 with screws 262. Slide member 256 has a first elongated guide slot 268 and a second elongated guide slot 270. Screws 264 and 266 serve as guide posts for the slide member 256. The first guide post 264 resides in the first guide slot 268 and the second guide post 266 resides in the second guide slot 270. The screws/guide posts 264 and 266 slidably attach the slide member 256 to the cutter base 250 using washers 272 and nuts 274. A return spring 277 is connected between a location 278 on the slide member 256 and the first guide post 264. An operator can use the tape cutter 216 to selectively cut tape 36 dispensing from tape outlet 34 at a location between the hard guide roller 212 and the creaser wheel 214 by gripping the handle 258 and pushing the slide member 256 downward so that the blade 260 presses against and cuts the tape.

In contrast to the blade 76 shown in FIG. 4, the cutting blade 260 in applicators having a tape cutter with a sharp downward orientation is a straight blade 260, FIG. 8. Typically, the edge of the blade 260 will be serrated and shaped like blade edge 78 shown in FIG. 6. However, the cutting edge 280 of the blade 260 can be V-shaped, as shown in FIG. 9. The V-shape is useful for at least two reasons: 1) the apex 282 of the V, FIG. 9, facilitates initial penetration of the tape by the blade 260, and 2) the stroke of the slide member 256 can be approximately ½ of the stroke for a cutter mechanism having a blade with a continually diagonal cutting edge as shown in FIG. 6. Although it is not shown, the edge of V-shaped blade 260 can be serrated.

Referring in particular to FIG. 7, an operator actuated tape break 69 can be mounted within the housing. The tape break 69 facilitates effective cutting of the tape. The preferred tape break 69 includes an operator actuated rubber stop 322 that can be moved upwards to squeeze the tape 36 against the positioning roller 58. The tape break 69 includes an actuation member 323, which is used to selectively engage the rubber stop 322 against the positioning roller 58, and a return spring 324 connected between the actuation member 323 and a frame 325 within the housing 12 to disengage the rubber stop 322 when the break 69 is not in use. The actuation member 323 has a substantially vertical upper stem 326 passing through the top of the housing 12. A finger grip 327 is provided at the top of the upper stem 326. The actuation member 323 also has a lower support stem 328 passing through the bottom 68 of the housing 12. A bushing 329 supports the lower stem 328 through the bottom 68 of the housing 12. The longitudinal axis of the lower stem 328 is preferably the same as the longitudinal axis of the upper stem 326. The actuation member 323 has a C-shaped middle portion 330 connecting the upper stem 326 to the lower stem 328. The C-shaped middle portion 330 attaches to the lower stem 328 at a location 331 which splits the lower stem 328 into a lower bushing support portion 332 and an upper break support portion 333. The actuation member 323 is preferably made of bent and soldered steel rod. The stop pad 322 is mounted to the upper portion 333 of the lower stem 328 of the actuation member 326. The stop pad 322 is preferably made of rubber. To actuate the break 69, a user gripping the top handle 71 pulls the actuation member 323 upwards against the force of the spring 324 by gripping finger grip 327. When the user releases the finger grip 327, the spring 324 pulls the actuation member 323 downward thus disengaging the stop pad 328 from the tape against the positioning roller 58.

FIGS. 11 and 12 show a corner roller 5 that can be used to press or wipe down tape that has been creased into a corner joint. The corner roller 5 includes a frame 292 preferably made of two metal frame members such as frame member 294. The frame 292 has a first end 296 and a second end 298. A first roller 300 is rotatably mounted to the first end 296 of the roller frame 292 between the frame members 294. A second roller 302 is rotatably mounted to the second end 298 of the roller frame 292 between the frame members 294. The roller frame 292 defines a longitudinal roller axis, and the axis of rotation for the first roller 300 and for the second roller 302 are perpendicular to the longitudinal roller axis. The diameter across the rollers 300 and 302 is about 3 ¼ inches, and the distance between the rollers along the longitudinal axis of the roller is about 4 ½ inches. A handle 304 is rotatably mounted to the roller frame 292, preferably between the frame members 294, at a position between the first end 296 of the roller frame and the second end 298 of the roller frame.

Referring now in particular to FIG. 12, each of the rollers 300, 302 has a generally V-shaped roller surface 306 for pressing joint tape over a corner joint. Each roller 300, 302 has a hard internal core 308 defined by a generally V-shaped cylindrical outer surface 310, having a radially outward extension 312 around the apex of the V-shaped outer surface 310. The hard core 308 has an internal cylindrical opening 314. Bushings 316 are press fit into the internal cylindrical opening 314 of the hard inner core 308. The bushings 316 support the rollers 300, 302 on a fixed axle 318 for rotation. The axle 318 is mounted to the frame members 294.

A layer of resilient material 320, preferably foam rubber, covers the outer surface 310 of the hard inner core 308 except along the outer edge 313 of the outward extension 312 around the apex of the hard inner core 308. The resilient material 320 extends about ⅛ of an inch above the outer surface 312 at the apex of the hard inner core 308. It is preferred that the angle of the V-shaped outer surface 306 of the rollers 300, 302 be between 85° and 89°.

In use, a worker grips the handle 304, and places each of the rollers 300 and 302 over the tape creased into a corner so that each roller lines up in the corner. As the user rolls and applies pressure to the tape, the resilient surface 320 will start to collapse slightly, and the outward extension 312 along the apex of the hard inner core 308 will guide the rollers 300 and 302 in the corner. The outward radial extension 312 of the hard inner core 308 also prevents the resilient material 320 from premature wear and tear.

Figure 19:
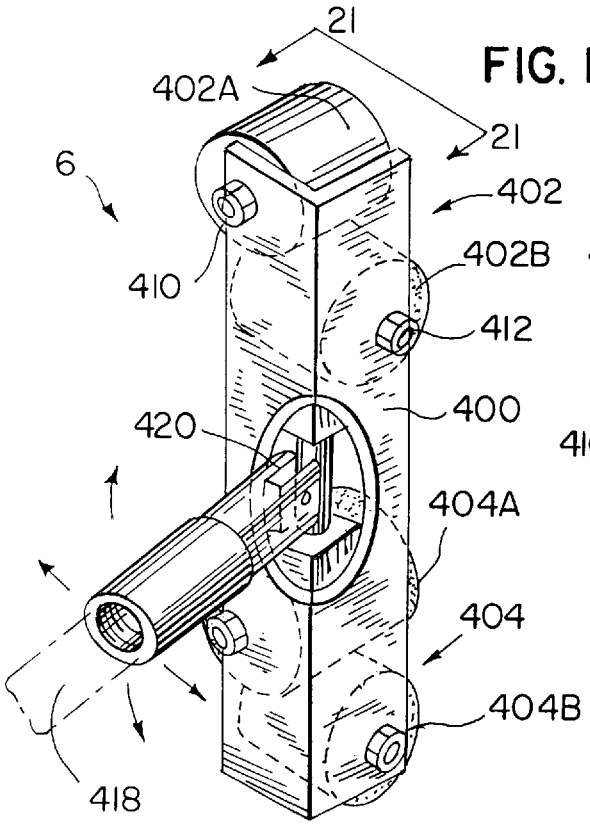
FIG. 19 is a perspective view of an alternative corner roller in accordance with the invention.
Figure 20:
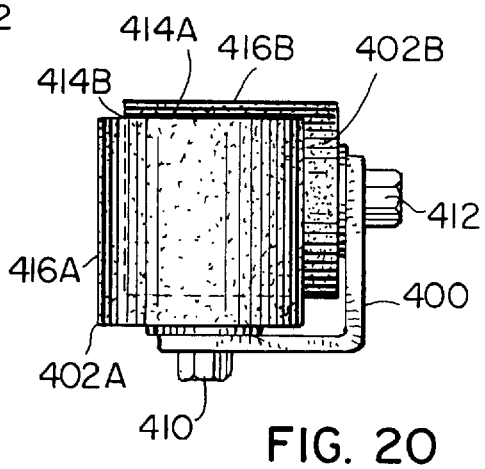
FIG. 20 is a partial top view of the corner roller shown in FIG. 19.
Figure 21:
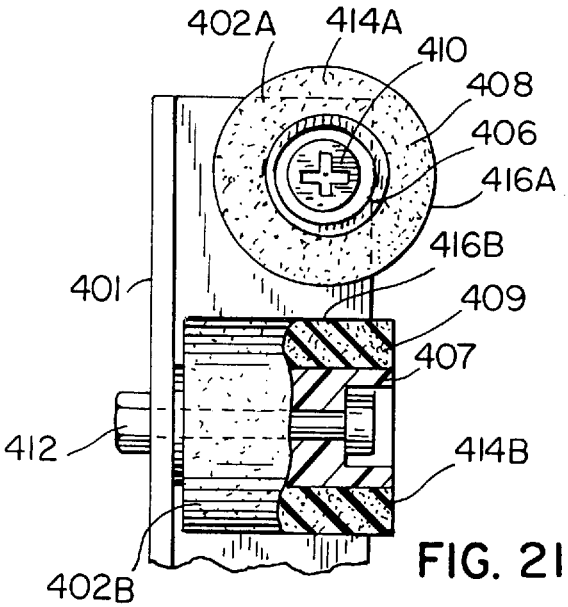
FIG. 21 is a detail view of part of the corner roller shown in FIG. 19 as taken along line 21—21 in FIG. 19.

FIGS. 19–21 show an alternative corner roller 6 that may be used to press or wipe down tape that has been creased into a corner joint. The corner roller 6 includes a metal frame 400. The metal frame 400 is preferably a right angle piece of steel about 7–10 inches in length. The corner roller includes a first pair of rollers 402 (402A, 402B) mounted to one end of the frame 400 and a second pair of rollers 404 (404A, 404B) mounted to the other end of the frame 400. Each of the rollers 402A and 402B, 404A and 404B have a hard cylindrical core 406, 407 and an outer foam rubber layer 408, 409 (FIG. 21). The rollers 402A, 402B, 404A, 404B thus each have a resilient surface that is adapted to press joint tape against a wall.

Referring to the first pair 402 of rollers 402A and 402B, the first roller 402A is mounted to the frame 400 for rotation around an axle 410 which defines a first axis of rotation. The second roller 402B is mounted to the frame 400 for rotation around an axle 412 which defines a second axis of rotation. The first 402A and second 402B rollers are mounted in close proximity to one another. The first 410 and second 412 axes of rotation are in substantially perpendicular directions. Thus, the first roller 402A is positioned to press joint tape onto one of two intersecting walls at a corner joint, while the second roller 402B is positioned to press joint tape onto the other intersecting wall at the corner joint.

Referring in particular to FIGS. 20 and 21, each roller 402A and 402B is mounted in a position so that an outer circular surface 414A, 414B facing outward from the roller frame 400 (i.e. in a direction perpendicular to the axes of rotation for the roller) does not contact the other intersecting wall at the corner joint. In particular, the path of the resilient surface 416B, 416A for each roller 402B, 402A extends outward beyond the circular face 414A, 414B of the other roller 402A, 402B even when the foam rubber layer 409, 408 is compressed. The second pair 404 of rollers 404A, 404B is constructed in substantially the same manner as the first pair 402 of rollers 402A, 402B.

The corner roller 6 also includes a handle 418 that is attached to the frame 400 with a universal joint 420. The universal joint 420 allows movement of the handle both up and down and side to side.

Various modifications, alternatives and equivalents to the invention shown in the drawings and described above may be apparent to those skilled in the art, and the following claims should be interpreted to include such modifications, alternatives or equivalents.

I claim:

1. An apparatus for applying adhesive-backed joint tape over flat joints between sections of wall, the apparatus comprising:

a housing having a tape outlet;

a tape holder mounted to the housing for holding a roll of adhesive-backed joint tape;

a tape guide positioned in the housing by the tape outlet, the tape guide having a non-stick surface exposed to an adhesive surface of the joint tape;

a positioning roller mounted to the housing in a fixed location relative to the tape guide, the positioning roller being located so that the non-adhesive surface of the joint tape contacts the positioning roller when the joint tape passes the positioning roller as the joint tape dispenses from the roll of joint when on the tape holder through the tape outlet, wherein the tape holder provides a sufficient amount of tension on the roll of tape so that contact of the non-adhesive surface of the joint tape maintains contact against the positioning roller when the joint tape is being applied over flat joints between sections of wall, thereby aligning the joint tape dispensing through the tape guide in a consistent direction from the positioning roller which does not vary as the roll of joint tape becomes smaller during use;

a cylindrical application roller having a resilient surface, the application roller being mounted to the housing and positioned to the exterior of the housing near the tape outlet so that the application roller contacts a non-adhesive surface of the joint tape as the joint tape dispenses through the tape outlet;

an operator actuated tape break that secures the joint tape from dispensing from the tape holder through the tape outlet in the housing when actuated, wherein the operator actuated tape break secures the the tape by squeezing the tape against the positioning roller; and a tape cutter to selectively cut joint tape dispensing from the apparatus at a location between the tape outlet and the application roller, the tape cutter cutting the joint tape from the side of the non-adhesive surface of the joint tape.

2. The apparatus as recited in claim 1 wherein the tape guide is a roller nip comprising a lower roller having an outer surface made of a non-stick material; and an upper roller, the upper roller and the lower roller being located in close proximity to each other in such position that the non-adhesive surface of the tape is exposed to the upper roller and the adhesive surface of the tape is exposed to the lower roller as the tape passes through the roller nip.

3. The apparatus as recited in claim 1 wherein the tape holder has an adjustable tensioner that can be tightened to increase the tension on the tape required for the dispensing of the tape.

4. The apparatus as recited in claim 1 wherein the tape cutter comprises:

at least two guide posts mounted in a generally stationary position with respect to the housing;

a slide member having one or more guide slots for receiving the guide post;

a cutting blade integral with a forward end of the slide member;

an operator handle integral with a rearward end of the slide member; and a return spring attached between the slide member and one of the guide posts;

wherein the tape cutter can be actuated by an operator to cut tape in the apparatus by pushing the operator handle on the slide member against the force of the return spring, so the slide member moves with respect to the guide posts along a path defined by the one or more guide slots in the slide member and the cutting blade on the slide member presses against the tape between the tape outlet and the application roller to cut the tape.

5. The apparatus as recited in claim 4 wherein the cutting blade has a V-shaped cutting edge.

6. An apparatus for applying adhesive-backed joint tape over a corner joint between sections of wall, the apparatus comprising:

a housing having a tape outlet;

a tape holder mounted to the housing for holding a roll of adhesive-backed joint tape;

a tape guide positioned in the housing by the tape outlet, the tape guide having a non-stick surface exposed to an adhesive surface of the joint tape;

a guide roller mounted to the housing and positioned to the exterior of the housing near the tape outlet, the guide roller contacting a non-adhesive surface of the tape as the tape dispenses through the tape outlet;

a narrow creaser wheel for creasing the adhesive-backed joint tape into the corner joint while keeping the two longitudinal edges of the tape free and unattached from the wall, the creaser wheel being mounted to the housing and positioned to the exterior of the housing in a spaced apart relationship to the guide roller, the creaser wheel having an edge contacting the non-adhesive surface of the tape after the tape passes the guide roller;

a positioning roller mounted to the housing in a fixed location relative to the tape guide, thereby aligning the joint tape dispensing through the tape guide in a consistent direction from the positioning roller which does not vary as the roll of joint tape becomes smaller during use;

an operator actuated tape break that secures the tape from dispensing from the tape holder through the tape outlet in the housing when actuated; and a tape cutter to selectively cut the tape dispensing from the apparatus at a location between the guide roller and the creaser wheel, the tape cutter cutting the tape from the side of the non-adhesive surface of the tape.

7. The apparatus as recited in claim 6 wherein the edge of the creaser wheel contacting the non-adhesive surface of the tape has a circumferential flat portion.

8. The apparatus as recited in claim 6 wherein the tape guide is a roller nip comprising a lower roller having a surface made of a non-stick material and an upper roller, the upper roller and the lower roller being in close proximity to each other in such a position that the non-adhesive surface of the tape is exposed to the upper roller and the adhesive surface of the tape is exposed to the lower roller as the tape passes through the roller nip.

9. The apparatus as recited in claim 6 further comprising a positioning roller mounted to the housing in a fixed location relative to the tape guide, the positioning roller being located so that the non-adhesive surface of the tape contacts the positioning roller when the tape passes the positioning roller as the tape dispenses from a roll of tape on the tape holder through the tape outlet.

10. The invention as recited in claim 9 wherein the operator actuated tape break secures the tape by squeezing the tape against the positioning roller.

11. The apparatus as recited in claim 6 wherein the tape holder has an adjustable tensioner that can be tightened to increase the tension in the tape required for dispensing of the tape.

12. The apparatus as recited in claim 6 wherein the tape cutter comprises:

at least two guide posts mounted in a generally stationary position with respect to the housing;

a slide member having one or more guide slots for receiving the guide post;

a cutting blade integral with a forward end of the slide member;

an operator handle integral with a rearward end of the slide member; and a return spring attached between the slide member and one of the guide posts;

wherein the tape cutter can be actuated by an operator to cut tape in the apparatus by pushing the operator handle on the slide member against the force of the return spring, so the slide member moves with respect to the guide posts along a path defined by the one or more guide slots in the slide member and the cutting blade on the slide member presses against the tape at a location between the guide roller and the creaser wheel.

13. The apparatus as recited in claim 12 wherein the cutting blade has a V-shaped cutting edge.

14. An apparatus as recited in claim 6 wherein the guide roller is a hard guide roller having an indentation for guiding the tape as the tape dispenses through the tape outlet.

15. A kit for applying adhesive-backed joint tape over flat joints and corner joints, the kit comprising:

a tape dispenser including a housing having a tape outlet, a tape holder mounted to the housing for holding a roll of adhesive-backed joint tape, an operator actuated tape break that secures the tape from dispensing from the tape holder through the tape outlet when actuated, and a tape guide positioned in the housing by the tape outlet;

a flat joint header that can be removably attached to the dispenser, the flat joint header including:

a cylindrical application roller having a resilient surface, the roller being positioned to the exterior of the housing near the tape outlet when the flat joint header is attached to the dispenser so that the application roller contacts a non-adhesive surface of the tape as tape dispenses through the tape outlet, and a tape cutter to cut the tape dispenser from the tape outlet at a location between the tape outlet the application roller; and a corner joint header that is removably attachable to the dispenser, the corner joint header including:

a guide roller that is positioned to the exterior of the housing near the tape outlet when the corner joint header is attached to the dispenser, a creaser wheel that is positioned to the exterior of the housing in a spaced apart relationship to the guide roller when the corner joint header is attached to the housing, the creaser wheel having an edge contracting the non-adhesive surface of the tape after the tape passes the guide roller, and a tape cutter to cut the tape dispensing through the tape outlet of the dispenser at location between the guide roller and the creaser wheel;

wherein the tape dispenser is adapted to permit removable attachment of the flat joint header and the corner joint header.

16. The kit as recited in claim 15 wherein:

the common dispenser has a top surface that includes at least one opening having a wide portion and a narrow portion, and a spring loaded boss extending upward from the top surface, the spring loaded boss being located closer to the wide portion of the opening than the narrow portion of the opening; and both the flat joint header and the corner joint header have a header base member to which a stud having a head is attached, the head of the stud fitting through the wide portion of the opening but not through the narrow portion of the opening.

17. The kit as recited in claim 15 further comprising a corner roller including:

a frame;

a handle mounted to the frame;

a first flat cylindrical roller mounted to the frame for rotation around a first axis of rotation;

a second flat cylindrical roller mounted to the frame for rotation around a second axis of rotation, the first and second rollers being mounted to the frame in close proximity to one another, and the first and second axes of rotation being in substantial perpendicular directions;

wherein both the first and second roller have a resilient cylindrical surface adapted to press joint tape onto one of two intersecting walls at a corner joint.

18. The kit as recited in claim 17 wherein the frame has a first end and a second end; the first and second flat cylindrical rollers define a first pair of rollers which are mounted towards the first end of the frame, and the corner roller further includes a third flat cylindrical roller mounted to the frame for rotation around a third axis of rotation, a fourth flat cylindrical roller mounted to the frame around a fourth axis of rotation, the third and fourth rollers being in close proximity to one another and the third and fourth axis of rotation being in substantially perpendicular directions, wherein the third and fourth rollers define a second pair of rollers which is mounted towards the second end of the frame.

19. The kit as recited in claim 17 wherein both the first and second flat rollers have an outer circular surface facing a direction perpendicular to the axis of rotation and the path of the resilient surface of the other roller extends outward beyond the location of the circular face.

20. The kit as recited in claim 15 wherein the guide roller for the corner joint header is a hard guide roller having an indentation that receives and guides the tape dispensing through the tape outlet.

* * * * *

UNITED STATES PATENT AND TRADEMARK OFFICE

CERTIFICATE OF CORRECTION

PATENT NO. : 5,814,184

DATED : September 29, 1998

INVENTOR(S) : JEFFREY L. DENKINS

It is certified that error appears in the above-indentified patent and that said Letters Patent is hereby corrected as shown below:

Claim 1, Col. 12, Line 21, after "joint" delete "when" and insert --tape--;

Signed and Sealed this

Fifth Day of January, 1999

*Attest:*

*Attesting Officer*

*Acting Commissioner of Patents and Trademarks*